US006634592B1

(12) United States Patent
Berousek

(10) Patent No.: US 6,634,592 B1
(45) Date of Patent: Oct. 21, 2003

(54) WIRE AND CABLE DESPOOLER

(76) Inventor: James Berousek, 721 Rancho Estates Blvd., Yukon, OK (US) 73099

( * ) Notice: Subject to any disclaimer, the term of this patent is extended or adjusted under 35 U.S.C. 154(b) by 0 days.

(21) Appl. No.: 10/162,307

(22) Filed: Jun. 4, 2002

(51) Int. Cl.[7] ..... B65H 49/26

(52) U.S. Cl. ..... 242/594.3; 242/404.2; 242/588.2; 242/597.4

(58) Field of Search ..... 242/588.2, 594.3, 242/594.4, 404.2, 597.4, 129

(56) References Cited

U.S. PATENT DOCUMENTS

| | | | | | |
|---|---|---|---|---|---|
| 672,543 | A | * | 4/1901 | Wirt | 242/404.2 |
| 2,699,918 | A | * | 1/1955 | Bush | 242/404.2 |
| 2,949,252 | A | * | 8/1960 | Schumann et al. | 242/594.3 |
| 3,383,071 | A | | 5/1968 | Godson | |
| 4,214,718 | A | | 7/1980 | Silkey | |
| 5,285,981 | A | * | 2/1994 | Pavelka | 242/594.3 |
| 5,330,120 | A | * | 7/1994 | Tussing | 242/588.2 |
| 5,690,301 | A | | 11/1997 | Shelton | |
| 5,944,280 | A | * | 8/1999 | Dimitri | 242/588.2 |
| 6,241,181 | B1 | | 6/2001 | Campbell | |
| 6,257,558 | B1 | | 7/2001 | Levine | |
| 6,270,094 | B1 | * | 8/2001 | Campbell | 242/594.4 |
| 6,367,754 | B1 | | 4/2002 | Cinker | |

* cited by examiner

*Primary Examiner*—John M. Jillions
(74) *Attorney, Agent, or Firm*—Randal D. Homburg

(57) ABSTRACT

The invention is a portable and detachable wire and cable despooler firmly attaching to dimensional lumber at a construction site, the despooler accepting pre-wound spools of cable, flexible hose or wire, or accepting unspooled rolls of wire, flexible hose and cable on spools which are part of the invention. The despooler securely clamps onto the dimensional lumber and one or more spools are attached to T-shaped extending arms, the multiple spools of wire and cable attaching to the extending arms secured by a pin placed through the end of the extending arms, allowing for the unrolling or despooling of the wire, flexible hose or cable without twisting or tangle. The despooler also allows for multiple spools of material to be dispensed independent of each other, such independence often necessary when pulling wire in new or existing construction.

2 Claims, 3 Drawing Sheets

WIRE AND CABLE DESPOOLER

CROSS REFERENCE TO RELATED APPLICATIONS

None

I. BACKGROUND OF THE INVENTION

1. Field of Invention

The invention is a portable and detachable wire and cable despooler firmly attaching to dimensional lumber at a construction site, the despooler accepting pre-wound spools of cable, flexible hose or wire, or accepting unspooled rolls of wire, flexible hose and cable on spools which are part of the invention. The despooler securely clamps onto the dimensional lumber and one or more spools are attached to T-shaped extending arms, the multiple spools of wire and cable attaching to the extending arms secured by a pin placed through the end of the extending arms, allowing for the unrolling or despooling of the wire, flexible hose or cable without twisting or tangle. The despooler also allows for multiple spools of material to be dispensed independent of each other, such independence often necessary when pulling wire in new or existing construction.

2. Description of Prior Art

The following United States patents were discovered and are disclosed within this application for utility patent. All relate to despooling devices, some attaching to dimensional lumber or wall studs. In U.S. Pat. No. 3,383,071 to Godson, a ladder shaped wire dispenser is disclosed that hangs from a horizontal overhead piece of dimensional lumber, with removable axles places through hooked arms located on the sides of the frame, holding a spool of wire between the frame members.

In U.S. Pat. No. 5,690,301 to Shelton, a spool holder is disclosed with a frame nailed to the dimensional lumber having a single arm extending outward from the frame holding a spool perpendicular to the wall. A similar wire dispenser is disclosed in U.S. Pat. No. 6,367,754 to Cinker, the device having two parallel crossbars connected to a single support member, which is a curved member, the crossbars attaching to a pair of wall studs with one crossbar place higher than another, the crossbars pinching the dimensional lumber with a downward force on the open end of the support member causing an increase in the amount of force applied by the cross bars. A number of additional components allow for multiple configurations of this device, each component attaching by a variety of fittings, pins and extensions, the device also adapting to attachment to a ladder.

A similar, "pinch" fit is disclosed in U.S. Pat. No. 4,214,718 to Silkey, this device providing two L-shaped bracket cradling a reel supporting pipe between the two L-shaped bracket, the reel supporting pipe placing the reel between two wall studs for dispensing.

A reusable wire distribution spool is disclosed in U.S. Pat. No. 6,241,181 to Campbell, which disclosed a two piece reel having a twisting means of attaching the tow halves of the reel, forming a spool upon which a wound material may be placed for dispensing.

II. SUMMARY OF THE INVENTION

The primary objective of the invention is to provide a simple and secure device to dispense one or more spools of wound material without tangle or twist, allowing for the independent dispensing of multiple spools of wound material.

A secondary objective of the invention is to provide the device with an attaching means that is secure no matter what direction the wire is dispensed. A third objective of the invention is to provide the dispenser with a quick means of replacing spools on the device without having to displace the attachment of the device from the dimensional lumber to which it is attached, the wound material dispensed away from the dimensional lumber instead of between the dimensional lumber.

III. DESCRIPTION OF THE DRAWINGS

The following drawings are submitted with this utility patent application.

FIG. 2 is a front view of a two piece spool, showing the base portion, the cap portion and the attaching bolts.

Figure 5A:
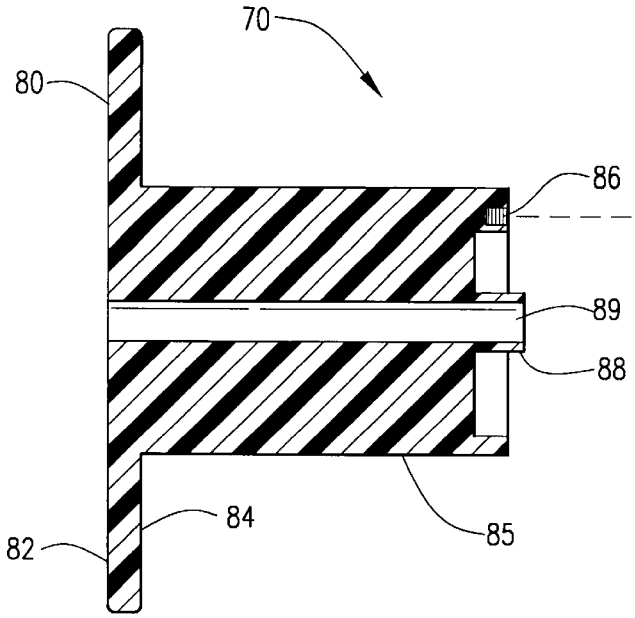

FIG. 5*a* is a cross section of the base portion of the spool.

Figure 5B:
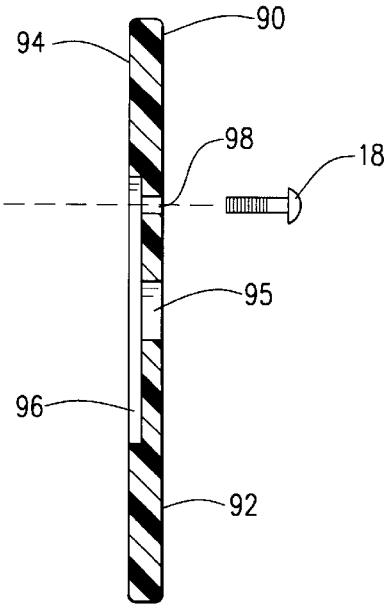

FIG. 5*b* is a cross section of the cap portion of the spool.

IV. DESCRIPTION OF THE PREFERRED EMBODIMENT

The invention is a portable wound spool despooler 10, as shown in FIGS. 1–5*b* of the drawings, securely clamped to dimensional lumber 100, for dispensing tangle-free and untwisted wire, cable or flexible hose, the despooler 10 comprising a frame member 20 having a support arm 22 attaching to a vertically positioned C-clamp channel member 30 having at least two threaded clamp pins 40 to engage the despooler to the dimensional lumber 100, the support arm 22 further providing an upright carrying handle 50, and two extending arms 60 perpendicular from the support arm, each extending arm having a cotter pin hole 66 accepting a cotter pin 14 to contain and hold at least one spool containing a wound material on each extending arm 60, either a despooler spool 70, provided with the despooler 10, or a factory spool supplied with the wound material.

Figure 1:
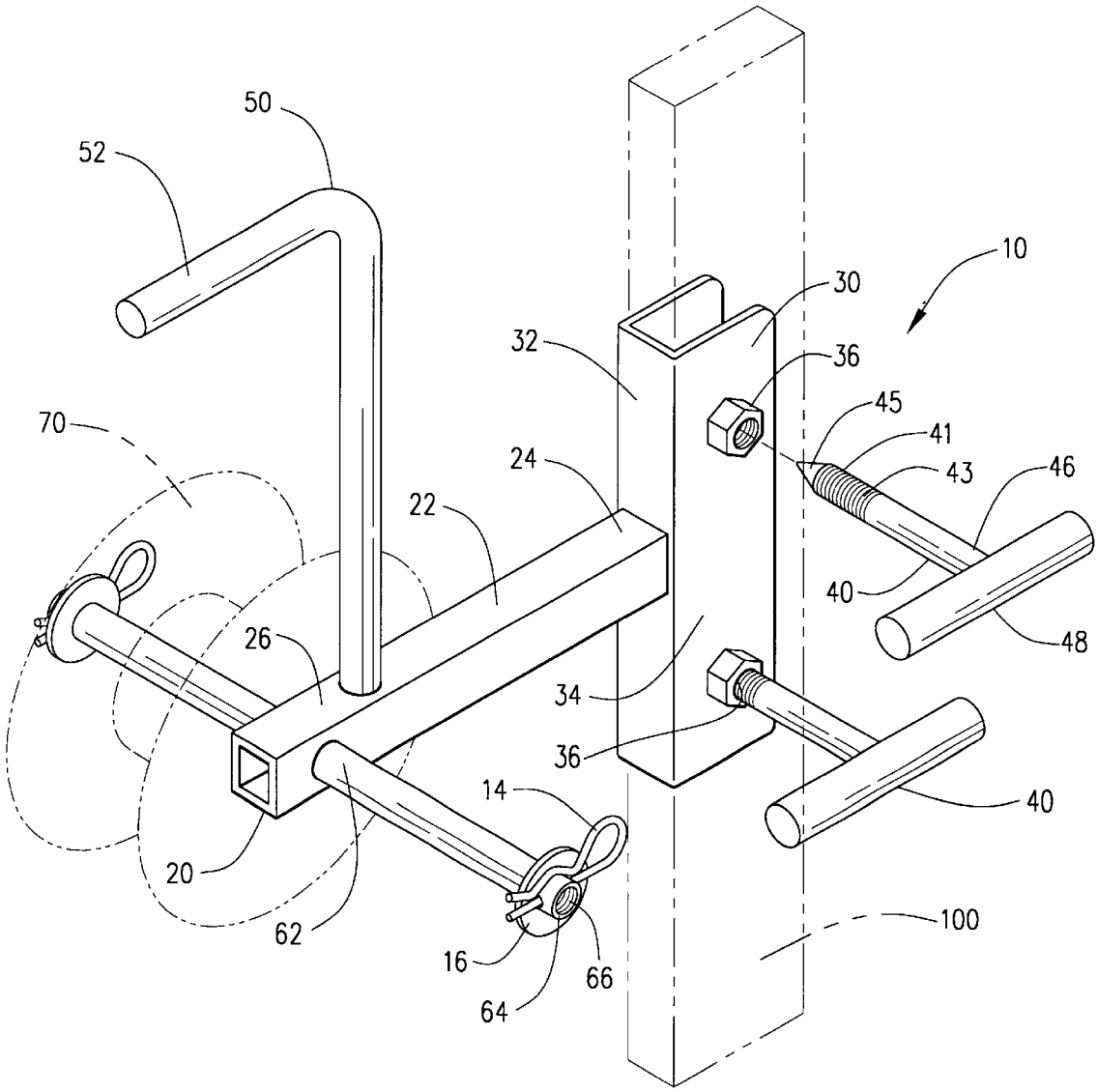
FIG. 1 is a perspective view of the despooler.

More specifically, as shown in FIG. 1, the support arm 22 has a first end 24 welded to a flat rear portion 32 of the C-clamp channel member 30 placing the support arm 22 perpendicular to the dimensional lumber 100 when the C-clamp channel member 30 is attached to the dimensional lumber 100. The C-clamp channel member 30 has two sides 34 containing at least two threaded holes 36, each threaded hole 36 receiving one of the threaded clamp pins 40. Each threaded clamp pin 40 has a first end 41 having external threads 43, the first end 41 tapered to a sharp point 45, and a second end 46 having a perpendicular twist bar 48 for applying force to the threaded clamp pin 40, driving the sharp point 45 on the first end 41 into the dimensional lumber 100.

A second end 26 of the support arm 22 has attached the two extending arms 60, the extending arms 60 perpendicular to the orientation of the C-clamp channel member 30. Each extending arm 60 has a first end 62 attached to the support arm 22 and a second end 64 including the cotter pin hole 66 accepting a cotter pin 14 and a washer 16, the second end 64 being flat and having an internally threaded receiver hole 68, which may accept an externally threaded extension arm (not shown). The upright carrying handle 50 extends upward from the support arm 22 and has a handle portion 52 to carry the frame member 20.

Figure 3:
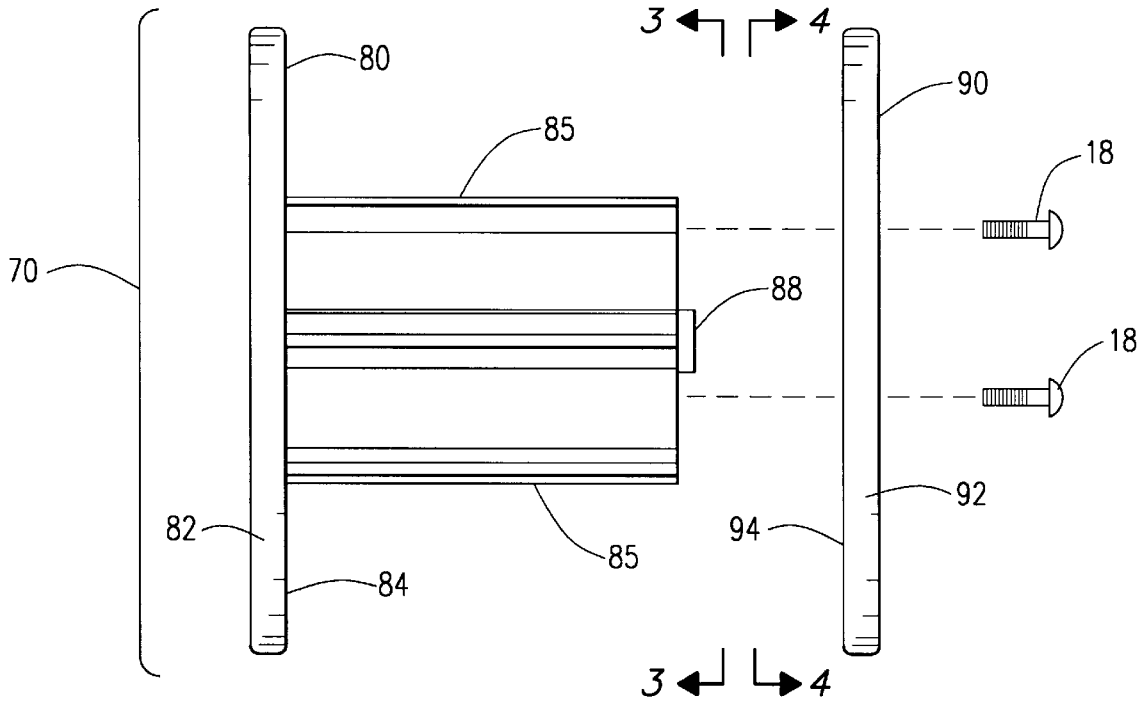
FIG. 3 is an end view of the base portion of the spool.
Figure 5:
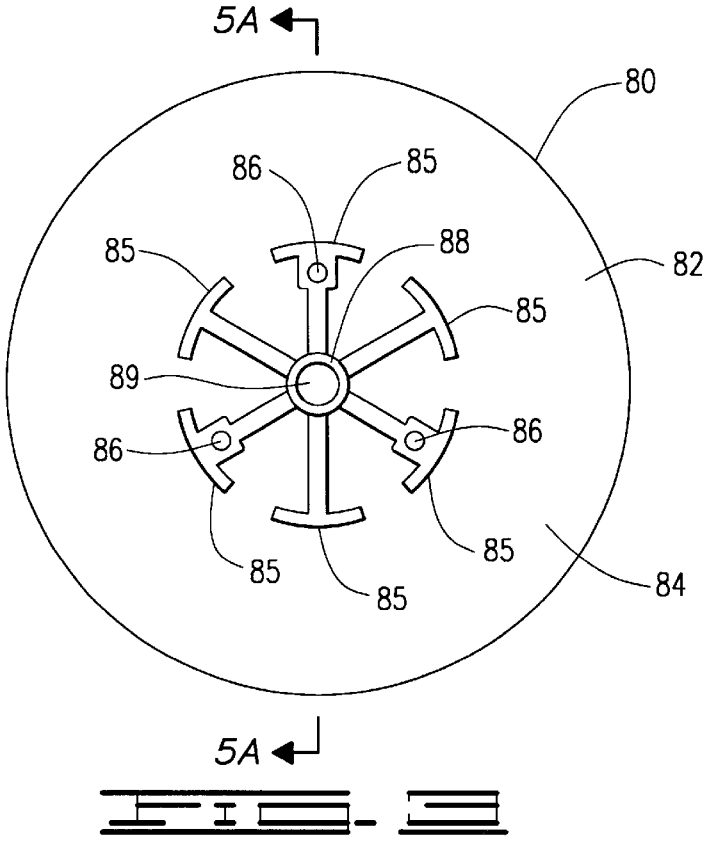

The despooler spools 70, shown in FIGS. 2–5*b*, provided in the despooler 10, are comprised of a base portion 80 and a connected cap portion 90. The base portion 90, shown in FIGS. 2, 3 and 5*a*, includes a rounded disk 82 having an inner surface 84 from which a plurality of hub members 85 extend, the hub members 85 positioned in a circle, with a single cylindrical shaft 88 having a central bore 89 extends, slightly further than the hub members 85. At least three of the hub members 85 have an internally threaded receiver hole 86. In a preferred embodiment, there are provided six hub members 85, three of which have internally threaded receiver holes 86, as shown in FIG. 3 of the drawings.

Figure 4:
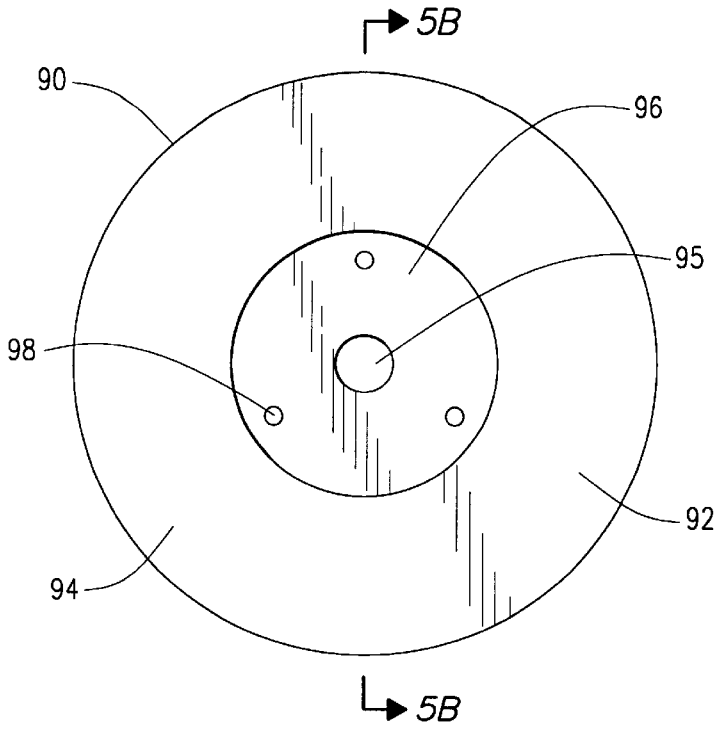
FIG. 4 is an end view of the cap portion of the spool.

The cap portion 90, shown in FIGS. 2, 4 and 5*b*, includes a rounded disk 92, having an inner surface 94 containing a circular cylindrical shaft receiver hole 95 receiving the cylindrical shaft 88 of the base portion 80 and a circular hub member receiving portion 96 accepting the plurality of hub members 85 from the base portion 80 when the base portion 80 and the cap portion 90 are attached. The cap portion 90 has at least three bolt holes 98, or at least the number of bolt holes 98 equal to the internally threaded receiver holes 86 in the base portion 80. A threaded bolt 18 is place through each bolt hole 98 in the cap portion 90, shown in FIGS. 2, 5*a* and 5*b*, engaging the internally threaded receiver holes 86 in the base portion 80, connecting the base portion 80 to the cap portion 90, forming the despooler spool 70. These bolts 18 are removed when the despooler spool 70 is empty and the base portion 80 and the cap portion 90 are separated. A roll of material is then placed on the plurality of hub members 85, after which the cap portion 90 is reattached to the base portion 80 and the bolts 18 are secured to the internally threaded receiver holes 86.

In an alternative embodiment (not shown), the hub members 85 and the rounded disk 82 of the base portion 80 are separate components attach with the bolts 18, and the cap portion 90 attaches to the hub members 85 not with bolts, but by simple engagement of the circular hub member receiving portion 96 and the hub members 85, with the cap portion 90 and base portion 80 held together by the washer 16 and the cotter pin 14 on the extending arm 60, the despooler spool 70 remaining together due to the containment between the support arm 22 and the washer 16. In this alternative embodiment, the internally threaded receiver holes 86 accept bolts 18 placed through bolt holes in the rounded disk 82 of the base portion 80, and the rounded disk 92 of the cap portion 90 would not have any bolt holes 98 nor have any bolts 18 to hold the cap portion 90 to the hub members 85.

Either a factory wound spool of material or the despooler spool 70 is placed on one of the extending arms 60 by placing the second end 64 of the extending arm 60 through central bore 89 of the cylindrical shaft 88, applying a washer 16 to the extending arm 60 and placing a cotter pin 14 through the cotter pin hole 66, securing the spool to the extending arm 60.

By using the despooler 10, wound material on the spool or despooler spool 70 is unwound without twist or tangle of the wound material. When multiple spools are used on the despooler 10, the spools may be dispensed independently, allowing the user to pull all the wound material at once, or individual strands. The C-clamp channel member 30, firmly attaching the despooler 10 to the dimensional lumber 100, provides for secure attachment without requiring someone to attend to the spools during pulling of the wound material by the user from another remote location, a common practice in the electrical trades.

While the invention has been particularly shown and described with reference to a preferred embodiment thereof, it will be understood by those skilled in the art that changes in form and detail may be made therein without departing from the spirit and scope of the invention.

What is claimed is:

1. A portable wound spool despooler, securely clamped to dimensional lumber, for dispensing tangle-free and untwisted wire, cable or flexible hose, the despooler comprising:

a frame member having;

a support arm having a first end and a second end;

a C-clamp channel member having a flat rear portion welded to the first end of the support arm, the support arm perpendicular to the dimensional lumber when the C-clamp channel member is attached to the dimensional lumber, the C-clamp channel member having two sides containing at least two threaded holes;

threaded clamp pins engaging the threaded holes, the threaded clamp pins having a first end having external threads, the first end tapered to a sharp point, and a second end having a perpendicular twist bar for applying force to the threaded clamp pin, driving the first end into the dimensional lumber;

two extending arms, the extending arms perpendicular to the orientation of the C-clamp channel member, each extending arm having a first end attached to the frame member and a second end having a cotter pin hole accepting a cotter pin and a washer, the second end being flat and having an internally threaded receiver hole;

a carrying handle extending upward from the support arm having a handle portion; and at least one despooler spool, having a base portion and a cap portion attached by bolts, the despooler spool placed on at least one extension arm of the frame member.

2. The despooler spool, as disclosed in claim 1, further comprising:

the base portion includes a rounded disk having an inner surface from which at least three hub members extend, the hub members positioned in a circle with at least three of the hub members having an internally threaded receiver hole, the base portion also having a single cylindrical shaft with a central bore extending from the rounded; and the cap portion including a rounded disk having an inner surface containing a circular cylindrical shaft receiver hole receiving the cylindrical shaft of the base portion and a circular hub member receiving portion accepting the plurality of hub members from the base portion when the base portion and the cap portion are attached, the cap portion having at least three bolt holes, wherein a threaded bolt is place through each bolt hole in the cap portion, engaging the internally threaded receiver holes in the base portion, connecting the base portion to the cap portion, forming the despooler spool.

* * * * *